US007569979B2

(12) United States Patent
Lykowski et al.

(10) Patent No.: US 7,569,979 B2
(45) Date of Patent: Aug. 4, 2009

(54) SPARK PLUG HAVING SPARK PORTION PROVIDED WITH A BASE MATERIAL AND A PROTECTIVE MATERIAL

(75) Inventors: James D. Lykowski, Temperance, MI (US); Iryna Levina, Minneapolis, MN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 49 days.

(21) Appl. No.: 11/697,124

(22) Filed: Apr. 5, 2007

(65) Prior Publication Data

US 2007/0236123 A1 Oct. 11, 2007

Related U.S. Application Data

(60) Provisional application No. 60/790,215, filed on Apr. 7, 2006.

(51) Int. Cl.
*H01T 13/20* (2006.01)

(52) U.S. Cl. ..... 313/143; 313/141; 313/142

(58) Field of Classification Search ..... 313/141–143
See application file for complete search history.

(56) References Cited

U.S. PATENT DOCUMENTS

| | | | | |
|---|---|---|---|---|
| 3,356,882 | A * | 12/1967 | Hallauer et al. | 313/141 |
| 3,958,144 | A | 5/1976 | Franks | |
| 4,725,254 | A * | 2/1988 | Moore et al. | 445/7 |
| 4,742,265 | A * | 5/1988 | Giachino et al. | 313/141 |
| 5,101,135 | A | 3/1992 | Oshima | |
| 5,675,209 | A * | 10/1997 | Hall, Jr. et al. | 313/141 |
| 5,779,842 | A | 7/1998 | Fawcett et al. | |
| 5,980,345 | A | 11/1999 | Chang et al. | |
| 6,326,719 | B1 | 12/2001 | Boehler et al. | |
| 6,885,135 | B2 | 4/2005 | Kanao et al. | |
| 2001/0002000 | A1 | 5/2001 | Kumar et al. | |
| 2002/0011768 | A1 | 1/2002 | Boehler et al. | |
| 2002/0074920 | A1 | 6/2002 | Chiu et al. | |
| 2002/0171346 | A1 | 11/2002 | Ulm et al. | |
| 2006/0011490 | A1 | 1/2006 | Nguyen et al. | |

FOREIGN PATENT DOCUMENTS

| | | | |
|---|---|---|---|
| JP | 02207476 | A * | 8/1990 |
| JP | 08339880 | A * | 12/1996 |
| JP | 2004031300 | A | 1/2004 |
| JP | 2004152682 | A | 5/2004 |

* cited by examiner

*Primary Examiner*—Mariceli Santiago
(74) *Attorney, Agent, or Firm*—Robert L. Stearns; Dickinson Wright PLLC

(57) ABSTRACT

A spark plug having a center electrode and a ground electrode wherein the spark portion of at least one of the center electrode and ground electrode includes a base material and a protective material that substantially prevents corrosion of the base material.

53 Claims, 9 Drawing Sheets

SPARK PLUG HAVING SPARK PORTION PROVIDED WITH A BASE MATERIAL AND A PROTECTIVE MATERIAL

CROSS-REFERENCE TO RELATED APPLICATION

This application claims the benefit of U.S. Provisional Application No. 60/790,215, filed Apr. 7, 2006, the entire disclosure of that application being considered part of the disclosure of this application and hereby incorporated by reference.

BACKGROUND OF THE INVENTION

The present invention is directed to a spark plug having a center electrode and a ground electrode. A portion of at least one of the center electrode and ground electrode includes a spark portion having a base material and a protective material to prevent corrosion of the base material.

Spark plugs are well known in the industry and have long been used to initiate the combustion in internal combustion engines. Spark plugs perform the basic function of igniting gases in an engine cylinder, the ignition of which creates the power stroke. Due to the very nature of internal combustion engines, spark plugs are exposed to many extremes occurring within an engine cylinder including high temperatures and various corrosive combustion gases which traditionally have reduced the longevity of the spark plug. Spark erosion may also reduce the longevity of the spark plug.

Electrical spark erosion is where the electrode and, in particular, the firing tip of a spark plug, erodes away during operation due to the periodic energy of the spark arc vaporizing the electrode material. Spark plugs traditionally have electrodes formed from Nickel or Nickel alloys which are susceptible to spark erosion. The use of new technology in engines to improve fuel economy has resulted in increased energy passing through the spark plug to force the spark to jump the gap between the center electrode and ground electrode and potentially a longer arc duration. This increased energy has increased the rate of spark erosion in materials susceptible to spark erosion and more spark plug manufacturers are turning away from commonly used Nickel or Nickel alloy materials in search of materials that are highly resistant to spark erosion such as Platinum, Iridium, or alloys thereof.

While Nickel and Nickel alloys traditionally have been very resistant to corrosion, many of the replacement metals or metal alloys, which are more resistive to spark erosion than Nickel or Nickel alloys, may also be susceptible to corrosion. The most common replacement materials for Nickel or Nickel alloys have been Platinum, Iridium, or alloys thereof. As Platinum and Iridium are generally expensive, it is desirable to minimize the amount of material used to provide the spark portion. Therefore, a spark portion formed out of Platinum or Iridium or alloys thereof is typically attached to a Nickel or Nickel alloy center electrode and minimized in size.

While Platinum and Platinum alloys are very good at reducing spark erosion, they may also be susceptible to corrosion. Furthermore, Platinum and Platinum alloys when used as the spark portion may alloy with combustion constituents and may form nodules or growths on the spark portion. Over time these growths may eventually interfere with the spark or change the spark gap or spark profile thereby reducing the performance of the spark plug. Furthermore, as some of the combustion gases may cause corrosion of the Platinum spark portion, such corrosion may cause the spark plug gap to change and thereby reduce the performance of the spark plug. Reduced performance of spark plugs can cause engine misfire, decreased fuel economy, and poor engine performance.

To improve performance of spark plugs and prevent growth of various materials on the spark portion of the spark plug, many manufacturers of spark plugs have recently been switching to Iridium as the discharge or spark portion. As Iridium has a very high melting point, it is also highly resistant to spark erosion but it is susceptible to oxidation and other corrosion at higher operating temperatures. However, as engine manufacturers increase electrical and thermal stresses to the spark plug through engine changes to improve fuel economy, it has been found that Iridium has a very volatile oxidation state at high temperatures, such as the upper end of the operating range of the spark plug (800-1100° C.) In comparison to traditional engines, these newer technology engines require more energy to be supplied through the spark plug to force the spark to jump the gap between the center electrode and ground electrode, and the operational temperature of the spark plugs has been increasing. At high temperatures an Iridium spark portion of a spark plug may experience severe corrosion.

In one particular mode, corrosion of the Iridium is believed to occur when Calcium and/or Phosphorus react with the Iridium to cause corrosion and erosion of the spark portion. The presence of Calcium and Phosphorus in combustion materials is a relatively more recent development as engine manufacturers attempt to increase fuel economy by reducing friction, and therefore, sometimes allowing more oil to seep into the combustion chamber. Calcium and Phosphorus are primarily present in engine oils and, in particular, oil additives. It is believed that Calcium and Phosphorus in the presence of oxygen during combustion within the engine cylinder react with the Iridium to form a volatile compound that evaporates and results in the loss of Iridium in the spark portion. More specifically, it is believed that gaseous Calcium during the combustion and exhaust cycle condenses on the Iridium spark portion of the spark plug and, in particular, the sides of the spark portion. It is known the molten Calcium dissolves Iridium and that Iridium is vulnerable to oxidation in the presence of Phosphorus. Therefore, the compound formed after the Phosphorus and oxygen react with the dissolved Calcium Iridium mixture is very volatile and subject to evaporation or vaporization which results in loss of the Iridium spark portion. More specifically this mechanism of corrosion with Phosphorus and Calcium typically corrodes the sides of the electrode, and not the spark surface facing the opposing electrode, which due to the activity of the spark on the spark surface is believed to prevent the accumulation of corrosive deposits. A diagram of a spark plug showing the loss of a portion of the spark portion is shown in FIG. 1. It should also be noted that Iridium may also experience some oxidation without the presence of Calcium and Phosphorus in the temperature range of about 800 to 1100° C. and with the presence of Calcium and Phosphorus the above described corrosion process may occur as low as 600° C., which is within the typical operating range of a spark plug. Of course, as engine compression increases, the temperature operating range of a spark plug will increase and oxidation of Iridium even without the presence of Calcium and Phosphorus will increasingly become a problem.

SUMMARY OF THE INVENTION n view of the above, the present invention is directed to a spark plug wherein at least one of a center electrode and ground electrode includes a spark portion having a base material that is highly resistant to spark erosion and a protective material that is highly resistant to the various corrosion mechanisms that a spark plug may experience. The protective material is a thin layer of metal alloy or layers of metal applied to the base material or formed with the base material as an external layer. The protective material may be formed out of an alloy having at least one element selected from the group consisting of Nickel, Platinum, Palladium, Rhodium, Iridium, Ruthenium, Rhenium, Copper, Chromium, Vanadium, Zirconium, Tungsten, Osmium, Gold, Iron, and Aluminum. The protective material may also have individual layers of elements selected from the above group.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 9:
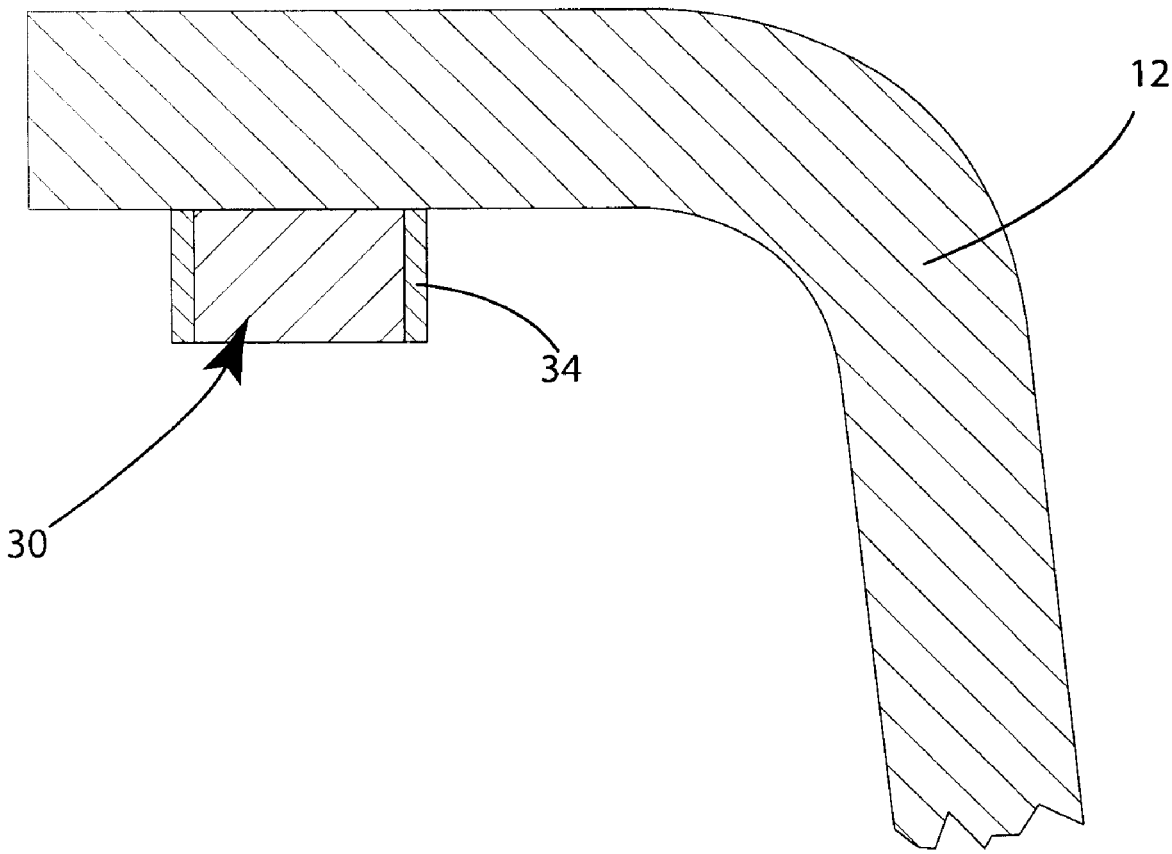
FIG. 9 is an enlarged sectional view of the ground electrode including a spark portion.

The present invention as illustrated in the figures is directed to a spark plug 10 (FIG. 2) having a ground electrode 12 and a center electrode 20. The center electrode 20 and/or the ground electrode 12 include a spark portion 30. The spark portion 30 may be bonded, welded 38, or otherwise attached to the center electrode 20 (FIG. 2) and/or the ground electrode 12 (FIG. 9).

Figure 10:
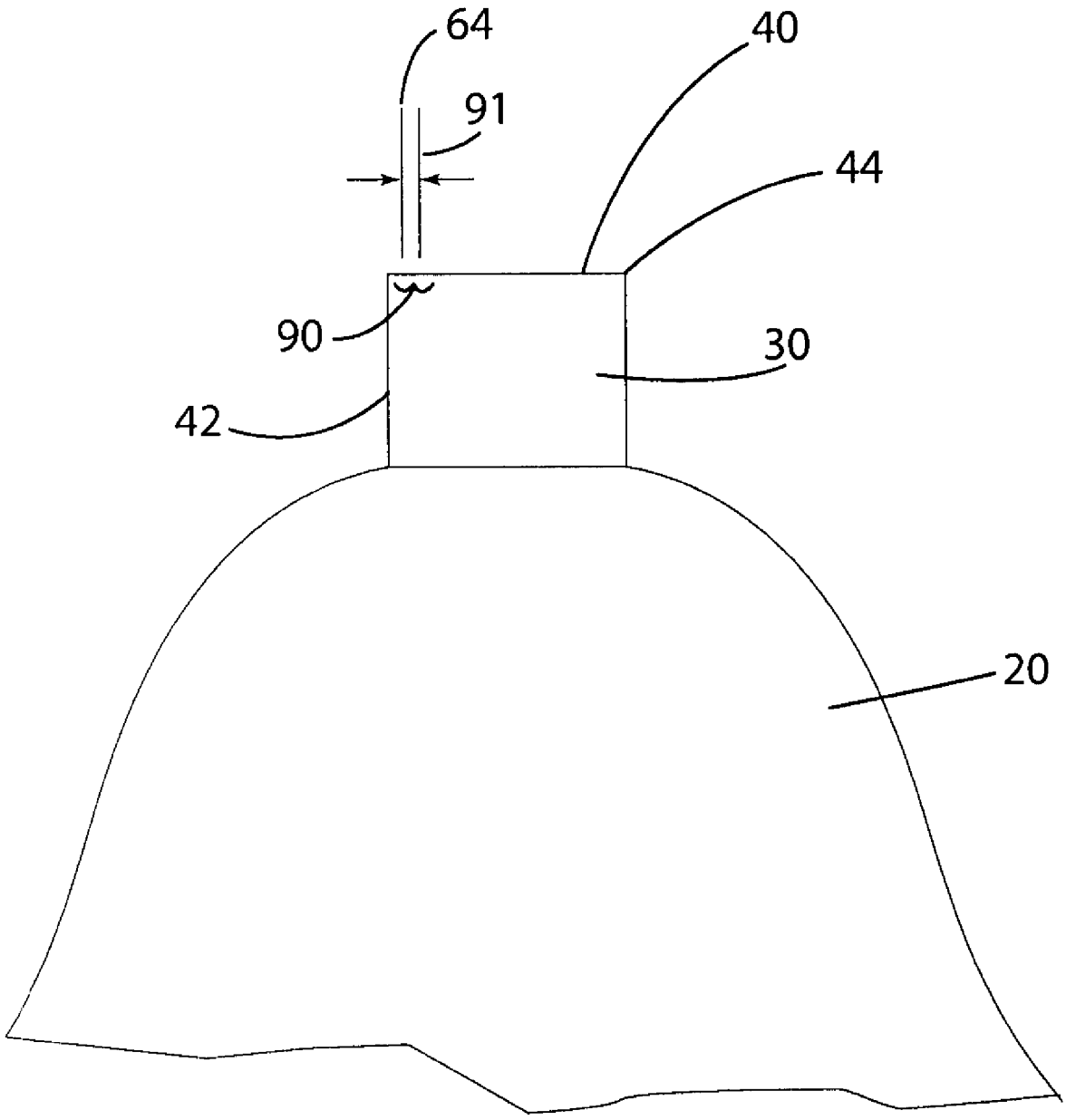
FIG. 10 is an enlarged sectional view of the spark portion illustrating the diffused boundary.

The spark portion 30 includes a base material 36 and a protective material 34 that generally forms an outer or protective layer (FIGS. 3-9). As illustrated in FIG. 10, the protective material 34 may become diffused with the base material, forming a spark portion 30 without a distinct layer between the protective material 34 and base material 36. More particularly, the base material 36 is primarily formed from a material resistant to spark erosion, such as Iridium (Ir), Platinum (Pt), Palladium (Pd), Rhodium (Rh), Ruthenium (Ru), Rhenium (Re), or alloys thereof. The most commonly used elements of the above group include Platinum and Iridium. Exemplary additions to form alloys of the above base material include one or more elements selected from the group consisting of Iridium, Platinum, Palladium, Rhodium, Ruthenium, Rhenium, Zirconium (Zr), Nickel (Ni), and Tungsten (W). Another exemplary base material 36 formed from an alloy is described in more detail in U.S. patent application Ser. No. 11/691,288, filed on Mar. 26, 2007 and entitled "Spark Plug". While the present invention contemplates Iridium or Platinum as the base material or an Iridium alloy or Platinum alloy, the present invention is not constrained only to the use of Iridium or Platinum, or Iridium or Platinum alloys, as the base material. Yet another exemplary Iridium alloy suited for use as the base material includes 94% to 99% Iridium, 1% to 3% Rhodium, 0.1% to 1.5% Tungsten, and 0.01% to 0.1% Zirconium by weight. For large industrial spark plugs, the base material typically has a diameter of approximately 1.8 mm to 4 mm, for vehicle spark plugs 0.4 mm to 2.1 mm, and hobby spark plugs 0.25 mm to 2.1 mm.

The protective material 34 prevents corrosion or oxidation of the base material. Also, as materials resistant to corrosion in the presence of Calcium and Phosphorus are typically susceptible to spark erosion, and that sparks typically originate on an edge 44 and/or spark surface 40 of the spark portion 30, the protective material must be formed thin enough so that the spark across the spark gap 14 primarily originates on the base material 36 and not the protective material 34 during continued operation of the spark plug. In some embodiments, for manufacturing ease, the discharge surface 40 may also be coated with a sacrificial protective material 36 that erodes away from the discharge surface 40 during operation, but remains on the sides of the spark portion 30 to protect against corrosion in the presence of Calcium and Phosphorus. As the protective material 34 is formed with a very thin layer of material, any gap changes due to spark erosion are not substantial to effect performance of the spark plug. Therefore, the protective material 34 is generally formed having a thickness of approximately up to 0.25 mm on the side of the spark portion 30 and more particular less than 0.12 mm, and yet more particularly less than 0.05 mm. In the embodiments where the discharge surface 40 is coated with a sacrificial protective material 36, it is preferred for the protective material to be less than 0.05 mm thick at least on the discharge surface 40. It has also been found that protective materials approximately equal to or less than 0.01 mm on the sides of the spark portion 30 provides sufficient protection to corrosion in the presence of Calcium and Phosphorus. In the embodiments where a thicker layer of protective material 36 is used, such as up to 0.25 mm, some spark erosion may occur near the edge 44 of the spark portion, however the edge 44 and discharge surface 40 of the spark portion 30 are typically not susceptible to corrosion in the presence of Phosphorus and Calcium as the spark activity prevents this Corrosion mechanism in the presence of Phosphorus and Calcium. Also, as the protective material 34 is formed from a very thin layer or layers of material, the layer of protective material 34 is substantially not susceptible to spark erosion, even at the edge 44. Therefore, with a thickness of less than 0.05 and more particularly 0.01 mm., the amount of material of the protective material 34 added or deposited to the base material 36 is minimal. Therefore, enough protective material is deposited to the outer circumference of the base material to form a spark portion 30 that is highly resistant to corrosion while minimizing the amount of material deposited to prevent excessive spark erosion near the edge 44.

The protective material 34 is particularly well suited for high performance spark plugs as it allows maximization of the benefits of the base material, while eliminating the need to be concerned about corrosion of the base material due to Calcium and Phosphorus. More particularly, instead of changing the alloy composition of the base material 36 to prevent corrosion in the presence of Calcium and Phosphorus, which may at times detrimentally effect the performance of the electrode, and more particular the performance of the spark portion 30, the base material 36 may maintain a maximized efficiency and performance with the protective material preventing corrosion in the presence of Calcium and Phosphorus.

Figure 3:
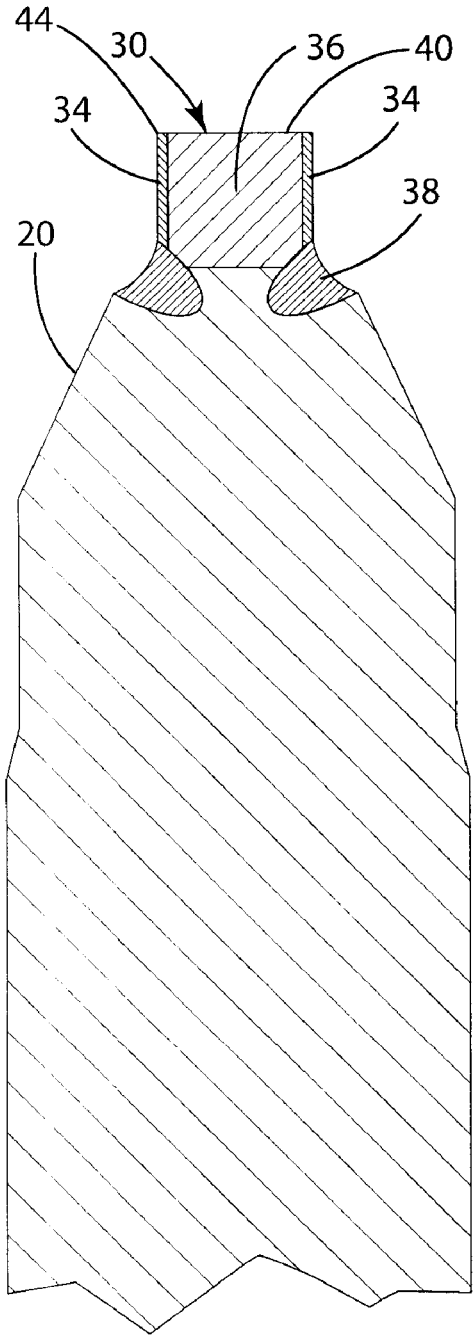
FIG. 3 is an enlarged sectional view of the center electrode including spark portion of the spark plug.
Figure 6:
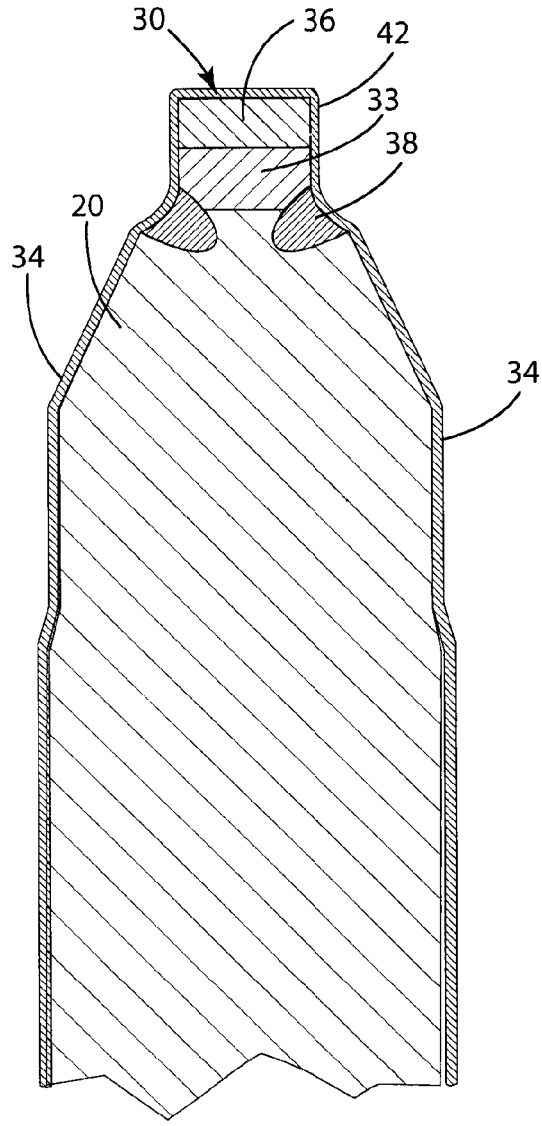
FIG. 6 is an enlarged sectional view of the center electrode including spark portion of the spark plug.
Figure 7:
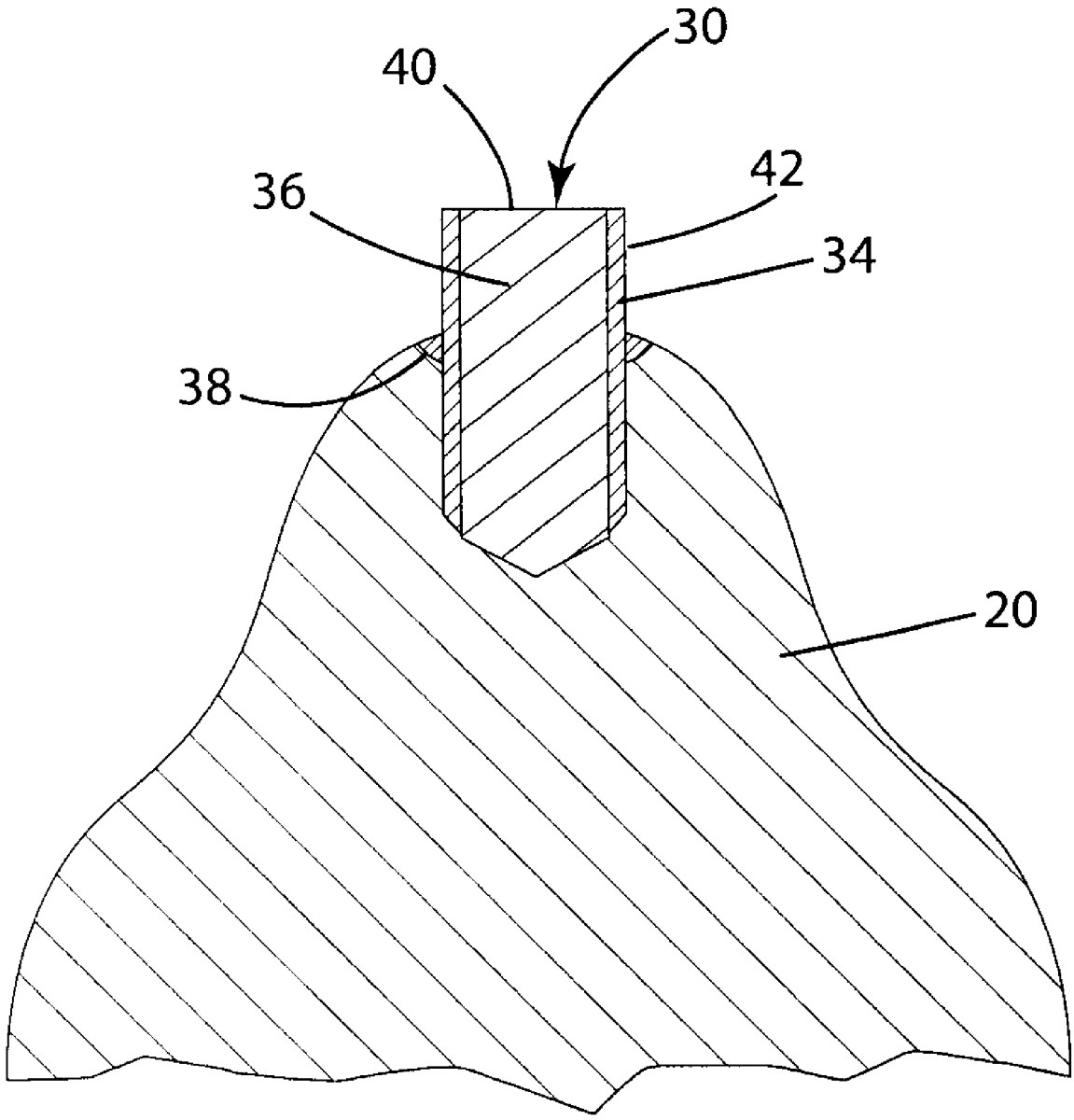
FIG. 7 is an enlarged sectional view of the center electrode including spark portion of the spark plug.
Figure 8:
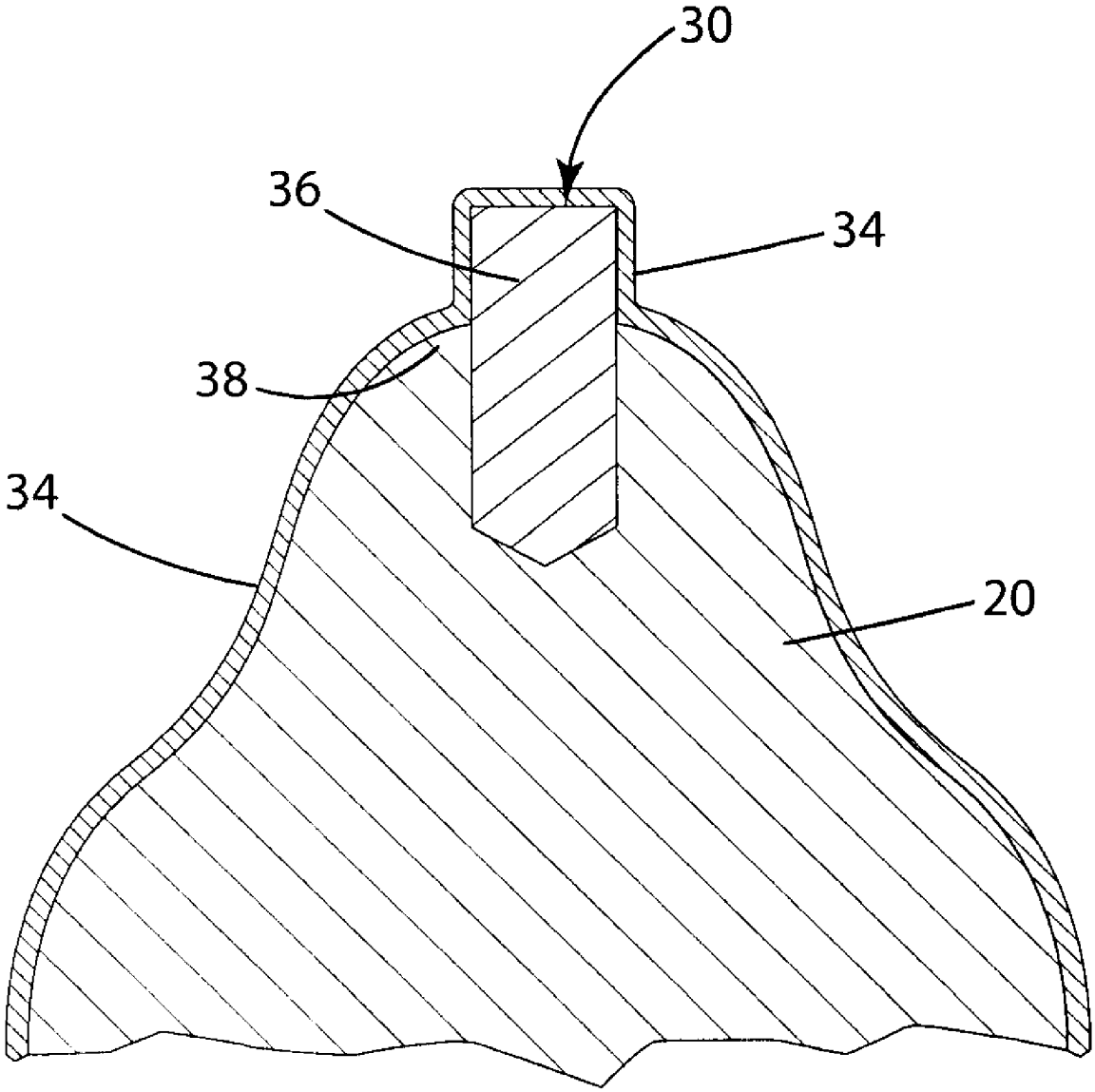
FIG. 8 is an enlarged sectional view of the center electrode including spark portion of the spark plug.

The spark portion 30 in the illustrated embodiment is shaped in a cylindrical or polygon shape having an outer circumference 42 and a first end or discharge surface 40. The end opposing the discharge surface 40 is attached to the center electrode 20. The center electrode 20 is generally formed out of Nickel or Nickel alloy, however other elements and alloys may be used, such as an Iron based center electrodes. As illustrated in FIGS. 3, 7, and 9, the protective material 34 does not extend over the first end or discharge surface 40 and in FIGS. 4-6 and 8 extends over the discharge surface 40. As the discharge surface 40 constantly has sparks emanating therefrom during operation, corrosion to the discharge surface is minimal or non-existent as the sparking predominately keeps the discharge surface free of corrosive elements thereby substantially eliminating corrosion of the discharge surface.

The protective material prevents the corrosion or oxidation of the base material 36. This protective material 34 may be formed from one or more of the elements selected from the group consisting of Iridium, Platinum, Palladium, Rhodium, Ruthenium, Rhenium, Copper, Chromium, Vanadium, Zirconium, Nickel, Tungsten, Gold (Au), Osmium (Os), Iron (Fe), and Aluminum (Al). The inventors have found that a protective coating of Nickel with one or more of the elements selected from the group consisting of Platinum, Palladium, Rhodium, Ruthenium, Rhenium, Copper, Chromium, Vanadium, Zirconium, Nickel, Tungsten, Gold (Au), Osmium (Os), Iron (Fe), and Aluminum (Al) provides enhanced protection against corrosion and oxidation. Furthermore, it has been found that an alloy forming the protective material 34 and including at least Nickel and Chromium or Copper provides excellent protection against corrosion and oxidation as well as longevity and durability. An exemplary protective layer which has been found to provide good corrosion resistance is approximately 85% Nickel and 15% Chromium by weight. It is believed that the inclusion of Iridium in the protective material 34 allows for a better bond or adhesion to a base material 36 formed primarily of Iridium thereby providing increased durability and longevity. Therefore, the protective material 34 may be formed with a portion of the base material to enhance the interconnection between the base material 36 and the protective material 34, thereby improving durability and longevity of the spark plug.

It has been found that the following alloys provide sufficient protection against corrosion and sufficient durability. These alloys include (1) Nickel and Copper, (2) Nickel and Chromium, (3) Nickel, Copper, and Chromium, (4) Nickel, Copper, plus one of the elements selected from the group consisting of Platinum, Palladium, Rhodium, Ruthenium, Rhenium, Vanadium, Zirconium, Tungsten, Gold, Osmium, Iron, and Aluminum, (5) Nickel, Chromium, and an element selected from the group consisting of Platinum, Palladium, Rhodium, Ruthenium, Rhenium, Vanadium, Zirconium, Tungsten, Gold, Osmium, Iron, and Aluminum, (6) Nickel, Copper, Chromium, and an element selected from the group consisting of Platinum, Palladium, Rhodium, Ruthenium, Rhenium, Vanadium, Zirconium, Tungsten, Gold, Osmium, Iron, and Aluminum, (7) Chromium, (8) Copper and Chromium, (9) Copper plus one of the elements selected from the group consisting of Platinum, Palladium, Rhodium, Ruthenium, Rhenium, Vanadium, Zirconium, Tungsten, Gold, Osmium, Iron, and Aluminum, (10) Chromium and an element selected from the group consisting of Platinum, Palladium, Rhodium, Ruthenium, Rhenium, Vanadium, Zirconium, Tungsten, Gold, Osmium, Iron, and Aluminum, (11) Copper, Chromium, and an element selected from the group consisting of Platinum, Palladium, Rhodium, Ruthenium, Rhenium, Vanadium, Zirconium, Tungsten, Gold, Osmium, Iron, and Aluminum.

Figure 11:
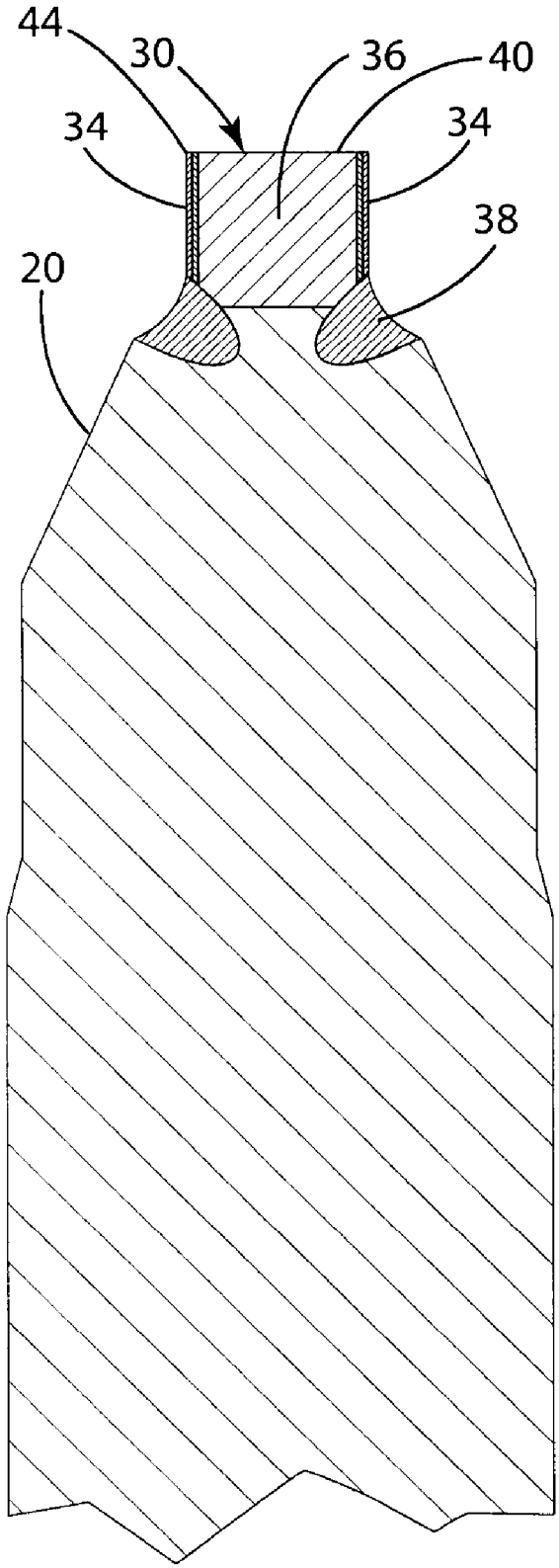
FIG. 11 is an enlarged sectional view of the center electrode including spark portion of the spark plug having multiple layers of protective material before diffusion of the protective material with the base material.
Figure 12:
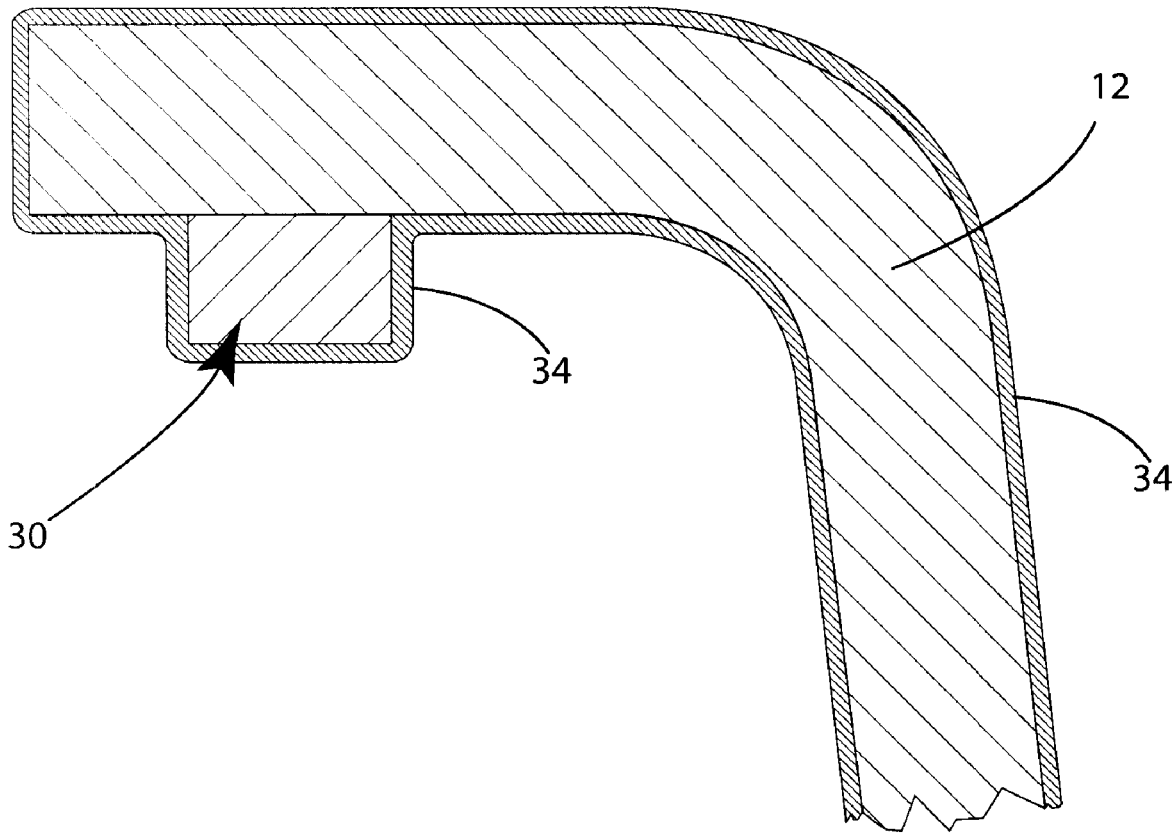
FIG. 12 is an enlarged sectional view of the ground electrode including a spark portion.

While the protective material 34 may be formed out of a single alloy as described above, each of the elements may also be placed in separate layers on the base material. It has been found that placing separate successive layers of each individual element instead of alloys thereof provides sufficient protection as desired and lowers the material cost. For example, if a base material is Iridium or an Iridium alloy, Copper may be applied as a first layer through plating and then Nickel may be applied as an outer layer through a successive plating option. Of course, Chromium could be substituted for the Copper to achieve similar corrosion resistant results. Of course, various orders of arrangement may also be used with the Nickel being on the inner layer and in direct contact with the base material. The inventors have also found that any arrangement of layers for protective materials including Copper, Nickel, and Chromium may be used, however one particularly useful protective layered material is formed by plating a Copper first layer 34*a* to the base material 36, a second layer 34*b* of Chromium adhered to the Copper through a plating operation and then a third layer 34*c* of Nickel adhered to the Chromium through a plating operation, as illustrated in an exaggerated sectional view in FIG. 11. However, it should be noted that as the individual layers may later become diffused together along with the base material.

By using a thin layer as described above, during the firing of the spark plug or component of the spark plug in a furnace during the manufacturing process and potentially the later operation of the spark plug in an engine, the protective material 34 becomes diffused into the base material 36, so that the protective material and base material are diffused together so that a definite boundary between the protective material 34 and base material 36 may be hard to determine, as illustrated in FIG. 10. More specifically, because the base material 36 is diffused with the protective material 34 around the outer circumference, in a cross-sectional view the spark portion 30 moves from being predominately protective material near the outer circumference 42 through a diffused area 90 where the amount of protective material continually decreases as the center of the base material is approached (FIG. 10). FIGS. 3-10 illustrate a protective material 34 in an exaggerated fashion as to the thickness before diffusion. As illustrated in FIG. 10, the illustrated layer being between approximately 100% protective material at the outer circumference and decrease to at least 10% where the inner boundary 91 is illustrated, even though no distinct boundary exists once diffusion occurs. More specifically, the diffused area 90 of protective material extends from the outer circumference 42 where the protective material 34 forms almost 100% of the material toward the center 32 of the spark portion 30 until the base material 36 is substantially predominate such as being more than 90% by weight at that given area forming the inner boundary 91. As illustrated in FIG. 10, an area 64 where equal amounts of base material and protective material may be found. One skilled in the art would recognize that FIGS. 3-9 for visual clarity illustrate the layer of protective material or diffused area as being much thicker relative to the base material than is described in the specification or claimed in the claims. Therefore, when the protective material 34 is diffused into the base material 36 it creates a very thin alloy portion of the base material and protective material.

As the spark plug in operation has the base material 36 diffused into the protective material 34 and the protective material 34 diffused into the base material 36, it is very difficult during operation for the protective material 34 to become separated from the base material 36 as may happen with thicker cladded materials. For example, a clad base with an outer layer having a thickness greater than 0.12 mm and more particularly a thickness of more than 0.25 mm, may have dissimilar thermal profiles due to the dissimilar materials which may have become separated over time as the spark plug continually fluctuates between hot and cold thermal cycles. Therefore, providing a thin layer that becomes diffused into the base material instead of having distinct individual layers allows the spark plug to increase the longevity of operation through increased spark erosion resistance, increased corrosion resistance, as well as increased durability.

Figure 1:
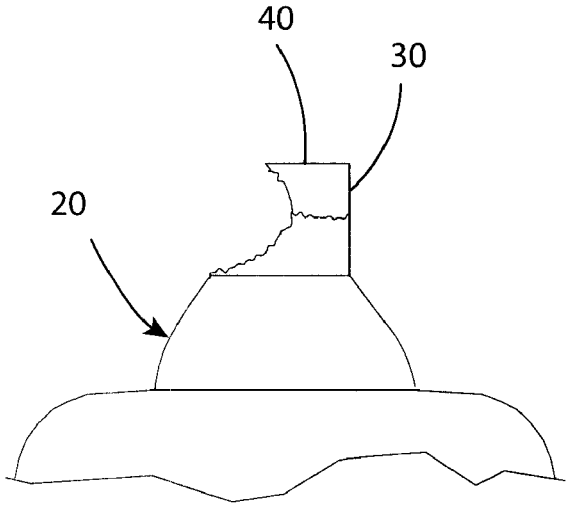
FIG. 1 is an exemplary diagram of an Iridium spark portion that has been severely corroded.
Figure 2:
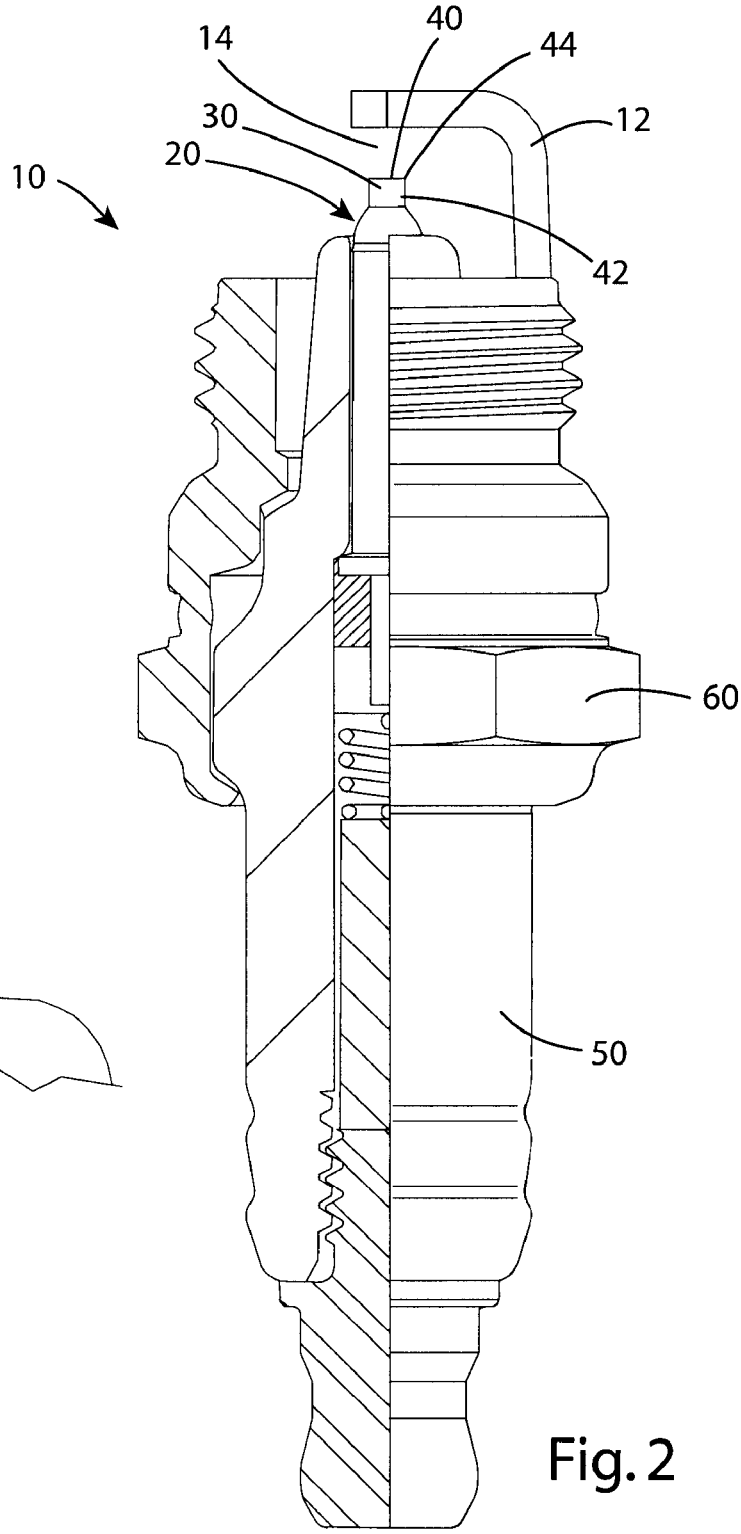
FIG. 2 is a partial sectional view of a spark plug.

The spark plug 10 including the spark portion 30 may be made through any known method. The manufacture of spark plugs is well known, including the addition of a spark portion 30 on the center electrode 20 and/or the ground electrode 12. In the present invention, the spark portion 30 may be bonded, resistance welded, laser welded, or attached through any known method to the center electrode 20 and/or ground electrode 12. The spark plug 10 generally includes a metallic shell, an insulator, and the center electrode 20 disposed in the insulator such that the spark portion 30 on the center electrode 20 projects toward the ground electrode 12 with the discharge surface 40 (FIG. 2).

The insulator is typically formed out of Alumina and has a passage through which the center electrode 20 extends. The metallic shell is formed out of a cylindrically shaped metal sleeve including threaded portions which thread into an engine block. The metallic shell is typically formed out of plain carbon steel but may be stainless steel or other materials.

The spark plug 10 may be made through any known method. The manufacture of spark plugs is well known including the addition of a spark portion 30 on the center electrode 20 and/or ground electrode 12. In the present invention the spark portion 30 may be bonded, resistance welded, laser welded, or attached through any known method. The spark plug 10 generally includes a metallic shell, an insulator, and the center electrode 20 disposed in the insulator such that the spark portion 30 on the center electrode 20 projects toward the ground electrode 12 with the discharge surface 40.

The spark portion 30 is generally first formed by forming the base material 36 from Platinum, Palladium, Rhodium, Iridium, Ruthenium, Rhenium, or alloys thereof. The base material 36 of the spark portion 30 may be formed through any known method. The base material 36 may be formed in metal sheets, discs, wires, or rods through hot forming, hot rolling, or hot wire drawing. Another method of forming the base material 36 is to take a metal powder and melt the powder to form the base material 36. The melting process may be done through arc melting, beam melting, laser melting, high frequency induction melting, plasma melting, or any other known method.

With the base material 36 formed in approximately the desired shape, typically in the form of an elongated rod or wire, the protective material 34 is then added to the base material 36 forming the rod or wire. The protective material 34 may be added through processes such as electrolytic on non-electrolytic plating, electrodeposition, sputtering, flame spraying, or even co-extrusion. It is key that the thickness of the protective layer when added to the base layer is not more than 0.25 mm, and more particularly it is helpful if the protective layer is less than 0.12 mm. Of course, any other means of providing a thin layer of less than 0.25 mm and more particularly less than 0.12 mm on the outside surface of a base material may be used to apply the protective material 34 to the base material 36. Once the spark portion 30 is formed with a protective material 34 on the outside of the base material 36, the elongated portion is cut, stamped, or pressed to the appropriate length and the individual pieces are prepared to be attached to either the center electrode 20 or the ground electrode 12.

Methods of attaching the spark portion to the ground electrode 12 and/or center electrode 20 include welding such as by resistance, laser, or other means to the center or ground electrode 12/20. Another method is to form impressions or depressions on the outer surface of the spark portion 30 to create mechanical locking mechanisms (not illustrated). The center electrode 20 is drilled out to the same diameter as the spark portion 30 and the spark portion 30 is inserted into the hole (FIG. 7). The center electrode 20 is then heated such as with a laser so that the metal melts around the inserted spark portion 30 and forms into the depressions on the outer surface. Of course other forming operations to the spark portion 30 such as making a headed rivet may be performed and then the spark portion may be attached to the center electrode 20 as is known in the art. Furthermore, the spark portion 30 may be attached to another wire or disc and welded thereto and then in turn welded to the center electrode 20 to enhance the bond between the center electrode 20 and the spark portion 30.

Figure 4:
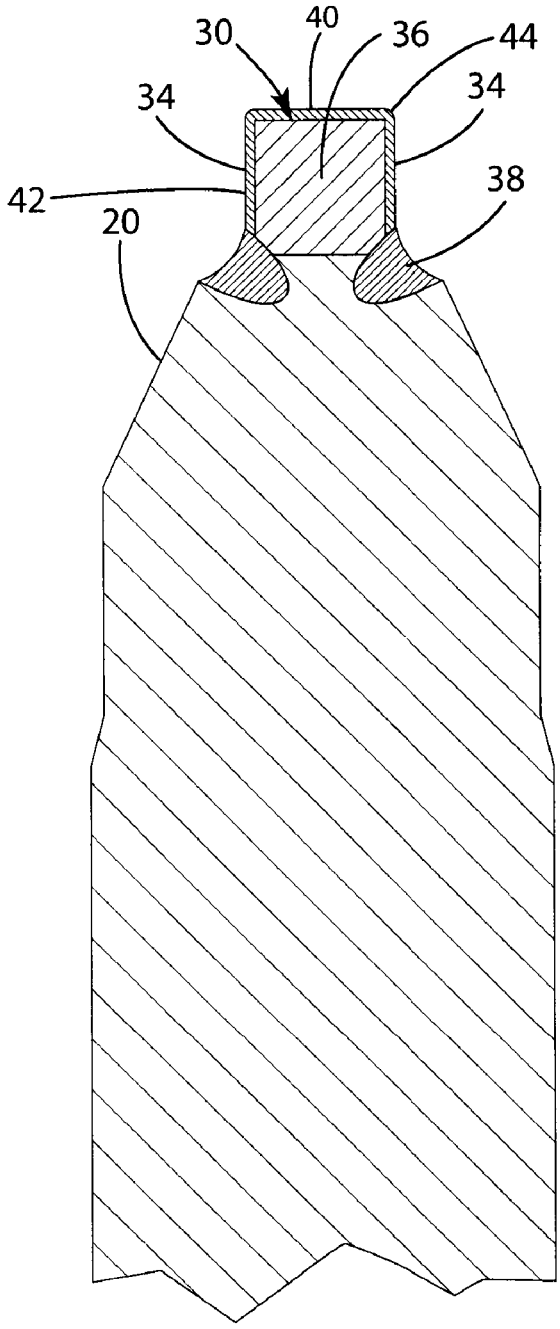
FIG. 4 is an enlarged sectional view of the center electrode including spark portion of the spark plug.
Figure 5:
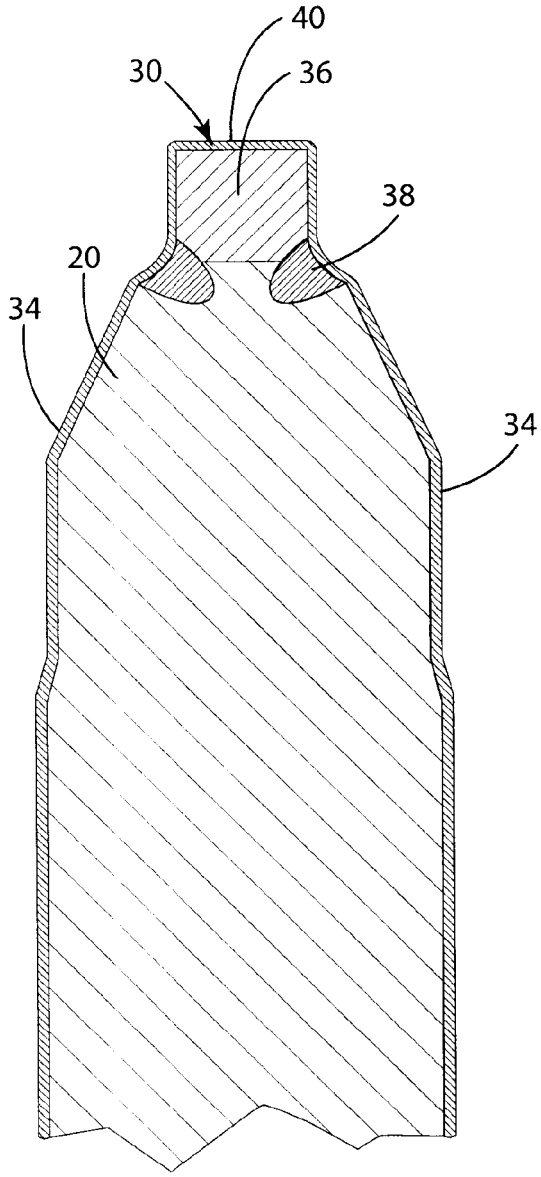
FIG. 5 is an enlarged sectional view of the center electrode including spark portion of the spark plug.

The center electrode 20 is illustrated in FIG. 3 welded directly to the center electrode 20, the center electrode 20 may be processed to reduce the diameter of the nickel tip 21 of the center electrode and provide a cavity 22 for receiving a spark portion 30. The spark portion 30 may include a variety configurations, such as an assembled spark portion 30 formed from more than one material and then having the protective material applied. More specifically as an example, the spark portion may be formed from a nickel portion and iridium portion, which is assembled onto the center electrode (FIG. 6). The protective material 36 may cover both portions and be applied before or after assembly to the center electrode. As illustrated in FIGS. 3 and 4, the spark portion 30 may be first processed to be coat the base portion 36 with the protective material 34. The spark portion 30 when coated with the protective material 34 is then welded to the center electrode 20. The weld pools 38 occur from the welding of the spark portion 30 to the center electrode 20. The spark portion 30 in FIGS. 5 and 6 is applied after the base material 36 is attached to the center electrode 20. More specifically, the base material 36 is attached to the center electrode 20, and then the protective material 34 is applied to the center electrode 20 and the base material 36. This allows for easy application of the protective material during the manufacturing process. In FIG. 6, a multi-layer rivet is formed as the spark portion having the base material attached to another material 33, typically Nickel alloy. An example of an assembled spark portion 30 may be found in U.S. patent application Ser. No. 11/602,028, filed Nov. 20, 2006, entitled "Method Of Forming A Spark Plug With Multi-Layer Firing Tip, U.S. patent application Ser. No. 11/602,146, filed Nov. 20, 2006, entitled "Spark Plug With Multi-Layer Firing Tip, and U.S. patent application Ser. No. 11/602,169, filed Nov. 20, 2006, entitled "Spark Plug With Multi-Layer Firing Tip", which are incorporated here by reference. As described above, just the spark portion 30 may include a layer of protective material, or the center electrode and base portion may include the layer of protective material. The protective material 34 is applied to the multi-layer rivet to form the spark portion 30. The multi-layer rivet spark portion 30 is then attached to the center electrode, such as by welding. The multilayer rivet in FIG. 6 is illustrated as being attached to the center electrode and then coated with the protective material however, it could first be coated with the protective material and then attached. FIG. 9 illustrates the spark portion 30 being applied to the ground electrode 12.

The protective layer 34 may also be added to the base material 36 by successive steps. More specifically, if a protective layer containing three elements is desired, the elements may be added successively with three distinct layers forming the protective layer. These layers may then be diffused together by heat or chemical treatment, or may diffuse together during operation in the engine.

Methods of attaching the spark portion 30 to the ground electrode 12 and/or center electrode 20 include welding such as by resistance, laser or other means to the center electrode 20 and/or ground electrode 12. Another method is to form impressions or depressions on the outer surface of the spark portion 30 to create a mechanical locking mechanism. The center electrode 20 is drilled out to the same diameter as the spark portion 30 and the spark portion 30 is inserted into the created hole. The center electrode 20 is then heated such as with a laser so that the metal melts around the rod and forms into the depressions on the outer surface of the rod.

The protective material may be further enhanced through chemical or heat treatment. The heat or chemical treatment may occur before or after the spark portion 30 is attached to the center electrode. For example, heat treatment of the spark portion 30 may occur during the final firing of the spark plug 10 so that the connection between the base material 36 and the protective layer 34 is enhanced by the protective layer 34 becoming diffused into the base material 36. The diffusing of the materials may happen so that the interface between the two layers creates a diffuse boundary layer instead of a distinct boundary. Furthermore, diffusing the interface between the two layers allows a more intimate connection at the molecular level as the two materials become similar, each having a portion of the other diffused within while providing the desired spark erosion resistance on the discharge surface as well as the desired corrosion resistance on the outer circumference.

During the manufacturing process, the protective material is at least partially diffused into the base material, which provides enhanced protection from corrosion. More specifically, during the firing of the glass seal, such as at temperatures above 530° C., the protective material starts to diffuse into the base material. For example, when a Nickel protective material 34 becomes diffused into a base material 36 of Iridium, the Iridium Nickel alloy provides enhanced protection that surpasses the performance of either Nickel or Iridium by itself. Therefore, the protective material forms a diffused area 39, as illustrated in FIG. 10. The diffused area 90 provides protection, even if the protective material that is not diffused 34 erodes away. Furthermore, it has been found that the combination of the base material with the protective material provides enhanced protection. More specifically, as the spark plug is fired to form the glass seal, typically at temperatures of about 750° C. to 1000° C., the protective material becomes diffused into the base material to form the diffused are 39. The diffused area, moving from the center of the spark portion, is primarily the base material, until a section 64 is reached that the base material and protective material are present in approximately equal amounts, to primarily the protective material proximate to the outer edge of the spark portion 30. The diffused area 90 is also proximate to the outer portion of the spark portion 30. Depending on the applied thickness of the protective material, the diffused area may not be exposed during the manufacturing process and the outer surface is only the protective material. However, during operation of the engine, the protective material may form the outer surface of the spark portion.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A spark plug having a center electrode and a ground electrode, and wherein at least one of said center electrode and said ground electrode comprise a spark portion including a base material including Iridium and a protective material comprising nickel and at least two elements selected from the group consisting of Platinum, Palladium, Rhodium, Iridium, Ruthenium, Rhenium, Copper, Chromium, Vanadium, Zirconium, and Gold.

2. The spark plug of claim 1 wherein said at least two elements are Iridium and Chromium.

3. The spark plug of claim 1 wherein said at least two elements are Copper and Chromium.

4. The spark plug of claim 1 wherein said protective material contains Nickel in an amount of 80-99% by weight.

5. The spark plug of claim 4 wherein said protective material contains Nickel in an amount of 80-95% by weight.

6. The spark plug of claim 1 wherein at least one of said at least two elements is selected from the group consisting of Platinum, Palladium, Rhodium, Iridium, Ruthenium, and Rhenium and wherein said at least one element forms less than 50% by weight of said protective material.

7. The spark plug of claim 1 wherein said at least two elements are selected from the group consisting of Platinum, Chromium Palladium, Rhodium, Iridium, Ruthenium, and Rhenium and wherein said protective material includes less than 90% by weight of said at least two elements.

8. The spark plug of claim 1 wherein at least one element of said at least two elements is selected from the group consisting of Copper, Chromium, Vanadium, Zirconium, and Gold and wherein said at least one element is less than 20% by weight of said protective material.

9. The spark plug of claim 8 wherein said protective material contains Iridium and wherein at least one element of said at least two elements selected from the group consisting of Copper, Chromium, Vanadium, Zirconium, and Gold.

10. The spark plug of claim 9 wherein said protective material contains less than 5% by weight of said at least one element.

11. The spark plug of claim 1 wherein said protective material contains greater than 0.5% by weight of said at least one element selected from the group consisting of Copper, Chromium, Vanadium, Zirconium, and Gold.

12. The spark plug of claim 1 wherein at least one element of said at least two elements is selected from the group consisting of Platinum and Iridium and the other of said at least two elements forms 0.5% to 50% by weight of said protective layer and is selected from the group consisting of Copper, Chromium, Vanadium, Zirconium, and Gold.

13. The spark plug of claim 12 wherein said protective material contains 5% to 30% by weight of said other of said at least two elements.

14. The spark plug of claim 1 wherein at least one element of said at least two elements is selected from the group consisting of Platinum and Iridium and the other of said at least two elements forms 7% to 25% by weight of said protective material and is selected from the group consisting of Copper, Chromium, Vanadium, Zirconium, Tungsten, Osmium, Gold, and Aluminum.

15. The spark plug of claim 14 wherein said other of said at least two elements forms 10% to 18% by weight of said.

16. The spark plug of claim 1 wherein said protective material includes at least one element selected from the group consisting of Platinum, Iridium, Copper, Palladium, Rhodium, Ruthenium and Rhenium and further includes Chromium in an amount of 0.5% to 20% by weight.

17. The spark plug of claim 16 wherein said protective material contains Chromium in an amount of 5% to 18% by weight.

18. The spark plug of claim 16 wherein said protective material one or more elements selected from the group consisting of Copper, Vanadium, Zirconium, and Tungsten, and wherein said one or more elements forms less than 10% by weight of said protective material.

19. The spark plug of claim 18 wherein said protective material includes Copper and wherein Copper forms less than 7% by weight of said protective material.

20. The spark plug of claim 1 wherein said base material contains 50% to 100% by weight Iridium, and said protective material contains 75% to 99% by weight Nickel, 5% to 25% by weight Chromium with the balance of the protective material being selected from one or more elements from the group consisting of Copper, Vanadium, Zirconium, Tungsten, Platinum, Palladium, Rhodium, Ruthenium, and Rhenium.

21. The spark plug of claim 20 wherein said base material contains 90% to 100% by weight Iridium, and said protective material contains 80% to 90% by weight Nickel, 10% to 20% by weight Chromium with the balance of the protective material being selected from one or more elements from the group consisting of Copper, Vanadium, Zirconium, Tungsten, Platinum, Palladium, Rhodium, Ruthenium, and Rhenium.

22. The spark plug of claim 20 wherein said protective material includes Copper in an amount of less than 10% by weight of the protective material.

23. The spark plug of claim 1 wherein said base material contains 50% to 100% by weight Iridium, and said protective material contains 0.001% to 90% by weight Nickel, contains Chromium and wherein Chromium forms less than 10% by weight of the protective material and less than 10% by weight Copper.

24. The spark plug of claim 1 wherein one of said at least two elements is Platinum.

25. A spark plug having a center electrode and a ground electrode, and wherein at least one of said center electrode and said ground electrode comprise a spark portion including a base material including Iridium and wherein said spark portion includes a protective material that contains Iridium and at least 80% Nickel by weight.

26. The spark plug of claim 25 wherein said protective material contains Nickel in an amount of 80% to 90% by weight.

27. The spark plug of claim 25 wherein said protective material includes at least one element selected from the group consisting of Platinum, Palladium, Rhodium, Ruthenium, and Rhenium and wherein said at least one element is less than 50% by weight of said protective material.

28. The spark plug of claim 25 wherein said protective material contains greater than 5% by weight of said at least one element selected from the group consisting of Copper, Chromium, Vanadium, Zirconium, and Gold.

29. The spark plug of claim 25 wherein said base material includes one or more elements selected from the group consisting of Platinum, Chromium, Palladium, Rhodium, Ruthenium, and Rhenium, and wherein said at least one element is present in an amount of less than 40% by weight of said protective material.

30. A spark plug having a center electrode and a ground electrode, and wherein at least one of said center electrode and said ground electrode comprise a spark portion including a base material including Iridium and a protective material comprising Nickel and Platinum and wherein said Platinum forms at least 90% of said protective material and wherein said protective material is diffused with said base material to form an alloy proximate to an outer surface of said spark portion, said alloy including said base material, Platinum, and Nickel.

31. The spark plug of claim 30 wherein said base material further includes Platinum and Nickel.

32. A spark plug having a center electrode and a ground electrode, and wherein at least one of said center electrode and said ground electrode comprise a spark portion including a base material including Iridium and a protective material comprising Copper and Chromium.

33. The spark plug of claim 32 wherein said protective material contains greater than 50% by weight Platinum.

34. The spark plug of claim 33 wherein said protective material contains greater than 80% by weight Platinum.

35. The spark plug of claim 32 wherein said protective material contains 1% to 40% by weight Chromium.

36. The spark plug of claim 32 wherein said protective material contains 1% to 40% by weight Copper.

37. The spark plug of claim 32 wherein said protective material contains 1% to 40% by weight of a combination of Chromium and Copper.

38. The spark plug of claim 37 wherein said protective material contains 1% to 80% by weight Platinum.

39. The spark plug of claim 32 wherein said protective material contains 0.5% to 20% by weight Copper and 0.5% to 20% by weight Chromium.

40. The spark plug of claim 32 wherein said protective material includes Nickel.

41. The spark plug of claim 32 wherein said protective material includes Nickel in addition to said at least one element selected from the group consisting of Vanadium, Zirconium, Tungsten, Platinum, Palladium, Rhodium, Iridium, Ruthenium, Rhenium, Gold, Osmium, Iron, and Aluminum.

42. The spark plug of claim 32 wherein said base material is predominately Iridium, and said protective material includes an element selected from said group consisting of Platinum, Chromium and Nickel, said protective material forming an alloy with said Iridium base material proximate the surface of the spark portion.

43. A spark plug having a center electrode and a ground electrode, and wherein at least one of said center electrode and said ground electrode comprise a spark portion including a base material including Iridium and a protective material formed from a first protective layer of Nickel and a second protective layer of Chromium and wherein said protective layers are at least partially diffused together and applied to said base material by electrolytic on non-electrolytic plating.

44. The spark plug of claim 43 further including protective layer of Copper between said protective layers of Nickel and Chromium.

45. The spark plug of claim 43 wherein said spark portion is heat treated to partially diffuse said protective material into said base material.

46. The spark plug of claim 43 wherein said spark portion is chemically treated to partially diffuse said protective material into said base material.

47. A spark plug having a center electrode and a ground electrode, and wherein at least one of said center electrode and said ground electrode comprise a spark portion including a base material including Iridium and a protective material and wherein said protective material is initially formed from at least two distinct layers, the first layer being selected from the group consisting of Nickel, Copper, Chromium, Vanadium, Zirconium, Tungsten, Platinum, Palladium, Rhodium, Iridium, Ruthenium, Rhenium, and Gold-and the second layer being formed from an element which does not form said first layer and wherein said protective material is at least partially diffused into said base material to form an alloy layer of said base material and said protective material proximate the outer surface of the spark portion and wherein said base material and said protective material are partially diffused together during manufacture of the spark plug.

48. A spark plug having a center electrode and a ground electrode and wherein at least one of said center electrode and said ground electrode comprise a spark portion including a base material including Iridium and a protective material comprising at least two layers, the first layer being selected from the group consisting of Nickel, Copper, Chromium, Vanadium, Zirconium, Tungsten, Platinum, Palladium, Rhodium, Iridium, Ruthenium, Rhenium, Gold, and Aluminum, and the second layer being formed from an element which does not form said first layer wherein said two layers and said ground electrode are diffused together during the manufacturing of the spark plug to form an alloy area proximate to an outer surface of the spark portion, and wherein in said alloy includes said base material and said two elements forming the first and second layers are selected from the group consisting of Nickel, Copper, Chromium, Vanadium, Zirconium, Tungsten, Platinum, Palladium, Rhodium, Iridium, Ruthenium, Rhenium, Gold, and Aluminum.

49. A spark plug having a center electrode and a ground electrode and wherein at least one of said center electrode and said ground electrode comprise a spark portion including a base material including Iridium and a protective material and wherein said base material and said protective material are diffused together to form an alloy layer substantially proximate to the outer surface of the spark portion, and wherein said alloy layer moves from being primarily protective material near the outer surface to primarily base material within approximately 0.3 mm.

50. The spark plug of claim 49 wherein said protective material is applied as a layer having a thickness of less than 0.25 mm.

51. The spark plug of claim 49 wherein said protective material is diffused into the base material through heating.

52. The spark plug of claim 49 wherein said base material includes an outer base circumferential surface and wherein when said spark portion is heated above 530° C., the boundary between said base material and said protective material becomes a diffused alloy.

53. The spark plug of claim 49 wherein said base material includes an outer base circumferential surface and wherein when said spark portion is heated between approximately 760° C.-820° C. to diffuse the boundary between said base material and said protective material to form a diffused alloy of the base material and protective material.

* * * * *